US008668606B1

(12) United States Patent
Gryspeerd

(10) Patent No.: US 8,668,606 B1
(45) Date of Patent: Mar. 11, 2014

(54) ARROW ACCESSORIES, ARROWS HAVING SUCH ACCESSORIES AND METHODS OF THEIR MANUFACTURING AND OPERATIONS

(71) Applicant: David Gryspeerd, Chesterfield, MI (US)

(72) Inventor: David Gryspeerd, Chesterfield, MI (US)

( * ) Notice: Subject to any disclaimer, the term of this patent is extended or adjusted under 35 U.S.C. 154(b) by 0 days.

(21) Appl. No.: 13/745,984

(22) Filed: Jan. 21, 2013

(51) Int. Cl.
*F42B 6/08* (2006.01)

(52) U.S. Cl.
USPC ..... 473/582; 473/583

(58) Field of Classification Search
USPC ..... 473/578, 582, 583, 584
See application file for complete search history.

(56) References Cited

U.S. PATENT DOCUMENTS

| | | | | |
|---|---|---|---|---|
| 2,691,527 | A * | 10/1954 | Ramsey | 473/583 |
| 2,820,637 | A * | 1/1958 | La Foud | 473/583 |
| 4,254,958 | A * | 3/1981 | Bateman, III | 473/583 |
| 4,405,133 | A * | 9/1983 | Cartwright, Jr. | 473/582 |
| 5,145,186 | A | 9/1992 | Maleski | |
| 6,283,880 | B1 | 9/2001 | Barrie | |
| 7,374,505 | B2 | 5/2008 | Polando | |
| 7,651,421 | B2 | 1/2010 | Smith et al. | |
| 8,016,703 | B1 | 9/2011 | Kronengold et al. | |
| 8,057,330 | B2 | 11/2011 | Blosser et al. | |
| D659,218 | S | 5/2012 | Palomaki et al. | |
| 2009/0163308 | A1 | 6/2009 | Odabachian et al. | |

OTHER PUBLICATIONS

Pat Norris Archery Online Catalog www.patnorrisarchery.com/catalog/images/sg/5315.jpg Jan. 8, 2013.
Cabela's: Adder Points Zoom Cabela's Online Catalog www.cabelas.com/catalog/largeImagePopup.jsp?productId=744846 Jan. 8, 2013.

* cited by examiner

*Primary Examiner* — John Ricci
(74) *Attorney, Agent, or Firm* — Goldstein Law Offices, P.C.

(57) ABSTRACT

An accessory for use with an arrow having an arrowhead and an arrow shaft. The arrowhead having a shank extending therefrom. The shaft having an open end operative to receive the shank. The accessory including a plate having a hole therethrough. The hole sized such that the shank is able to pass therethrough. The accessory further including a skirt depending from the plate. The accessory also including a plurality of fins downwardly depending from the skirt. The fins having forward-facing serrated edges.

20 Claims, 4 Drawing Sheets

ARROW ACCESSORIES, ARROWS HAVING SUCH ACCESSORIES AND METHODS OF THEIR MANUFACTURING AND OPERATIONS

TECHNICAL FIELD

Generally, the present disclosure relates to archery. More particularly, the present disclosure relates to arrows.

BACKGROUND

In the present disclosure, where a document, an act and/or an item of knowledge is referred to and/or discussed, whether directly and/or indirectly, this reference and/or discussion is not an admission that the document, the act and/or the item of knowledge and/or any combination thereof was at the priority date, publicly available, known to the public, part of common general knowledge and/or otherwise constitutes prior art under the applicable statutory provisions and/or is known to be relevant to an attempt to solve any problem with which the present disclosure is concerned.

Archery involves an archer operating a bow/crossbow to propel an arrow for entertainment, sports, hunting and/or combat purposes. A typical arrow includes an arrowhead, such as a broadhead, coupled to an arrow shaft. Many ways for coupling the arrowhead to the shaft are known. One of such ways involves the arrowhead having a shank and the shaft having an open end. The arrowhead is coupled to the shaft when the shank is inserted into the open end. When the shank and/or the open end are correspondingly threaded, then the shank can be screwed into the open end and/or vice versa.

Many hunters use broadhead arrows when hunting for prey. However, such hunts become more difficult when the prey possess small vital areas, keen eyesight, natural wariness and/or rapid mobility. For example, when a wild turkey is hit with a broadhead arrow, then the wounded turkey is often still able to dash and/or hide in nearby bushes/thick brush, fly away and/or run away so that the hunter is unable to catch up to the turkey in order to recover the turkey. Also, when the wounded turkey runs away from the hunter, the turkey often leaves little tracks and/or blood trail for the hunter to follow. Moreover, the turkey can escape with the hunter's arrow, which can be costly. Such occurrences are frequently due to the broadhead arrow insufficiently damaging the turkey's vital organs upon impact and/or passing fully through the turkey's torso.

In order to reduce at least some of such occurrences, some hunters attempt to quickly immobilize, severely injure and/or instantly kill the turkey by coupling devices to arrows that reduce arrow penetration, which results in more internal organ/tissue damage and/or greater shock to the turkey. Other hunters use mechanically expandable broadheads and/or place forward facing serrated edges on the broadheads, which similarly results in reduced arrow penetration, increased tissue/organ damage and/or greater shock to the turkey. However, these attempts can demand specialized arrowheads, reduce arrow's aerodynamic balance and/or adversely impact on arrow's flight accuracy.

While certain aspects of conventional technologies have been discussed to facilitate the present disclosure, no technical aspects are disclaimed. The claims may encompass one and/or more of the conventional technical aspects discussed herein.

BRIEF SUMMARY

The present disclosure addresses at least one of the above. However, the present disclosure may prove useful in addressing other problems and/or deficiencies in a number of technical areas. Therefore, the claims, as recited below, should not be necessarily construed as limited to addressing any of the particular problems and/or deficiencies discussed herein.

An example embodiment of the present disclosure includes an accessory for use with an arrow having an arrowhead and an arrow shaft. The arrowhead having a shank extending therefrom. The shaft having an open end operative to receive the shank. The accessory including a plate having a hole therethrough. The hole sized such that the shank is able to pass therethrough. The accessory further including a skirt depending from the plate. The accessory also including a plurality of fins downwardly depending from the skirt. The fins having forward-facing serrated edges.

Another example embodiment of the present disclosure includes an accessory for use with an arrow having an arrowhead and an arrow shaft. The arrowhead having a shank extending therefrom. The shaft having an open end operative to receive the shank. The accessory including a plate having a hole therethrough. The hole sized such that the shank is able to pass therethrough. The plate having a periphery. The accessory further including a skirt depending from the periphery. The accessory even further including a plurality of spines downwardly depending from the skirt. The accessory yet even further including a first set of parallel fins extending from one of the spines. Each fin in the first set having having forward-facing serrated edges. The accessory also including a second set of parallel fins extending from another one of the spines. Each fin in the second set having having forward-facing serrated edges.

Yet another example embodiment of the present disclosure includes an arrow including an arrowhead having a shank extending therefrom. The arrow further including an arrow shaft having an open end in receipt of the shank. The arrow even further including a plate having a hole therethrough. The shank within the hole. The plate between the arrowhead and the shaft. The arrow yet even further including a skirt depending from the plate. The skirt positioned over the shaft. The arrow also including a plurality of fins downwardly depending from the skirt. The fins having forward-facing serrated edges. The fins positioned over the shaft further than the skirt.

The present disclosure may be embodied in the form illustrated in the accompanying drawings. Attention is called to the fact, however, that the drawings are illustrative. Variations are contemplated as being part of the disclosure, limited only by the scope of the claims.

BRIEF DESCRIPTION OF THE DRAWINGS

The accompanying drawings illustrate example embodiments of the present disclosure. Such drawings are not to be construed as necessarily limiting the disclosure. Like numbers and/or similar numbering scheme can refer to like and/or similar elements throughout.

DETAILED DESCRIPTION OF THE PREFERRED EMBODIMENTS

Figure 1A:
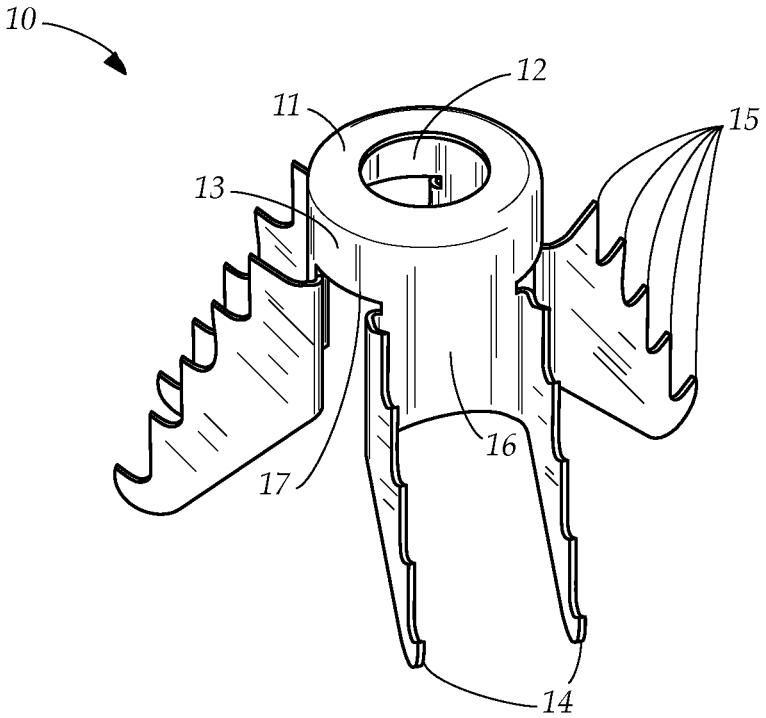
FIG. 1A shows a perspective view of an example embodiment of an arrow accessory according to the present disclosure.

The present disclosure will now be described more fully with reference to the accompanying drawings, in which example embodiments of the disclosure are shown. The disclosure may, however, be embodied in many different forms and should not be construed as being limited to the embodiments set forth herein. Rather, these embodiments are provided so that this disclosure will be thorough and complete, and will fully convey the concept of the disclosure to those skilled in the art. Also, features described with respect to certain embodiments may be combined in various other embodiments. Different aspects and elements of the embodiments may be combined in a similar manner.

Any verbs as used herein can imply direct or indirect, full or partial, action or inaction. For example, when an element is referred to as being "on," "connected" or "coupled" to another element, then the element can be directly connected or coupled to the other element or intervening elements may be present. In contrast, when an element is referred to as being "directly connected" or "directly coupled" to another element, there are no intervening elements present.

Although the terms first, second, etc. may be used herein to describe various elements, components, regions, layers and/or sections, these elements, components, regions, layers and/or sections should not be limited by these terms. These terms are only used to distinguish one element, component, region, layer or section from another element, component, region, layer or section. Thus, a first element, component, region, layer or section discussed below could be termed a second element, component, region, layer or section without departing from the teachings of the present disclosure.

The terminology used herein is for the purpose of describing particular embodiments only and is not intended to be necessarily limiting of the disclosure. As used herein, the singular forms "a," "an" and "the" are intended to include the plural forms as well, unless the context clearly indicates otherwise. The terms "comprises," "includes" and/or "comprising," "including" when used in this specification, specify the presence of stated features, integers, steps, operations, elements, and/or components, but do not preclude the presence or addition of one or more other features, integers, steps, operations, elements, components, and/or groups thereof.

Example embodiments of the disclosure are described herein with reference to illustrations of idealized embodiments (and intermediate structures) of the disclosure. As such, variations from the shapes of the illustrations as a result, for example, of manufacturing techniques and/or tolerances, are to be expected. Thus, embodiments of the disclosure should not be construed as limited to the particular shapes of regions illustrated herein, but are to include deviations in shapes that result, for example, from manufacturing. Any components and/or materials can be formed from a same, structurally continuous piece and/or be separately manufactured and/or connected.

Unless otherwise defined, all terms (including technical and scientific terms) used herein have the same meaning as commonly understood by one of ordinary skill in the art to which this disclosure belongs. The terms, such as those defined in commonly used dictionaries, should be interpreted as having a meaning that is consistent with their meaning in the context of the relevant art and will not be interpreted in an idealized or overly formal sense unless expressly so defined herein.

Furthermore, relative terms such as "below," "lower," "above," and "upper" may be used herein to describe one element's relationship to another element as illustrated in the accompanying drawings. Such relative terms are intended to encompass different orientations of the device in addition to the orientation depicted in the accompanying drawings. For example, if the device in the accompanying drawings is turned over, elements described as being on the "lower" side of other elements would then be oriented on "upper" sides of the other elements. Similarly, if the device in one of the figures is turned over, elements described as "below" or "beneath" other elements would then be oriented "above" the other elements. Therefore, the example terms "below" and "lower" can, therefore, encompass both an orientation of above and below.

If any disclosures are incorporated herein by reference and such incorporated disclosures conflict in part or whole with the present disclosure, then to the extent of conflict, and/or broader disclosure, and/or broader definition of terms, the present disclosure controls. If such incorporated disclosures conflict in part or whole with one another, then to the extent of conflict, the later-dated disclosure controls.

FIG. 1A shows a perspective view of an example embodiment of an arrow accessory according to the present disclosure.

An accessory 10 has a plate 11, which has a hole 12 therethrough. Hole 12 is sized such that an arrowhead shank is able to pass therethrough. Plate 11 can be rigid, flexible and/or any combination thereof. Plate 11 can be even leveled, non-even leveled and/or any combination thereof. Plate 11 can have a circular, oval, square, triangular, rectangular, trapezoidal, pentagonal and/or any other shape. Plate 11 can include metal, plastic, rubber, wood and/or any other materials. Hole 12 can have a circular, oval, square, triangular, rectangular, trapezoidal, pentagonal and/or any other shape. Plate 11 can be smooth, non-smooth and/or any combination thereof.

A skirt 13 depends from plate 11. Skirt 13 can partially and/or fully depend from plate 11. Skirt 13 partially and/or fully depends from the periphery of plate 11. In another example embodiment, skirt 13 partially and/or fully depends from non-periphery areas of plate 11. For example, such dependency can allow for lips, irrespective of size, on plate 11. Skirt 13 can depend from plate 11 in order to be relatively snug with an arrow shaft. However, skirt 13 can depend plate 11 in order to be relatively away from the arrow shaft so to avoid being snug with the arrow shaft.

Skirt 13 can depend from plate 11 in an aligned, non-aligned, linear, non-linear, angled manner and/or any combination thereof. Skirt 13 can include metal, plastic, rubber, wood and/or any other materials. Skirt 13 can have a linear bottom edge and/or a non-linear bottom edge, such as wavy, zigzagged and/or any other. Skirt 13 can be smooth and/or non-smooth. Skirt 13 can be rigid, flexible and/or any combination thereof. Skirt 13 can have a height equal or non-equal to diameter of plate 11. In another embodiment, accessory 10 lacks skirt 13.

A plurality of fins 14 downwardly depend from skirt 13. Fins 14 have forward-facing serrated edges as defined by teeth 15. Fins 14 can include metal, plastic, rubber, wood and/or any other materials. Fins 14 can be rigid, flexible and/or any combination thereof. Fins 14 can be can be smooth, non-smooth and/or any combination thereof. Fins 14 can partially and/or fully depend from skirt 13. Such depending can be aligned, non-aligned, linear, non-linear, angled and/or any combination thereof. All fins 14 can be identical, whether in size, weight and/or properties, to each other, different from each other, even within a fin set and/or a single fin, and/or any combination thereof. Fins 14 can be organized into sets, such as pairs, triplets and/or others. Within each set, at least two fins 14 can be parallel or non-parallel, whether convergent and/or divergent, to each other. Any amount of fin sets 14 can be used, such as two, three, four, five, six and more. As shown in FIG. 1A, accessory 10 includes three fin sets 14. Fin sets 14 can be set to for aerodynamic balancing. Forward-facing edges can be include aligned and/or angled, whether diverging and/or converging to each other and/or toward the arrowhead and/or the arrow shaft. In another example embodiment, a set of fins 14, such as a pair of parallel fins 14, can have another fin 14 across and/or in-between, such as in a perpendicular and/or non-perpendicular manner, like diagonal.

Fins 14 have teeth 15, which can include metal, plastic, rubber, wood and/or any other materials. There can be any number of teeth 15, such as three, five, fifty and others. Teeth 15 can be rigid, flexible and/or any combination thereof. Teeth 15 can be can be smooth, non-smooth and/or any combination thereof. Whether in size, weight and/or properties, all teeth 15 on each and/or other fins 14 can be identical to each other, different from each other, even within a fin set and/or a single fin, and/or any combination thereof. At least some and/or all teeth 15 can be sharp at least for hunting, dull and/or any combination thereof. Whether in size, weight and/or properties, some and/or all teeth 15 can be serrated in one pattern having many sub-patterns, one identical pattern, different patterns and/or any combinations thereof. Fin sets 14 can be serrated identically to each other and/or differently from each other and/or any combination thereof. Teeth 15 can be sharpened pre and/or post use. In other example embodiments, fins 14 can also include serrated read-facing edges, which can be serrated identical to and/or different from teeth 15 in any manner as disclosed herein. One of teeth 15 can include several teeth and/or sub-teeth. Teeth 15 can be rounded, sharply peaked, spiked, wavy and/or any combination thereof.

Skirt 13 includes a spine 16 downwardly depending from skirt 13. Such depending can be aligned, misaligned, linear, non-linear, angled and/or any combination thereof. At least some of fins 14 can extending from spine 16. Spine 16 can partially and/or fully depend from plate 13. Spine 16 depends from the bottom edge of skirt 13. In another example embodiment, skirt 13 depends from the non-bottom edge of skirt 13. Spine 16 can include metal, plastic, rubber, wood and/or any other materials. Spine 16 can have a linear bottom edge and/or a non-linear bottom edge, such as wavy, zigzagged and/or any other. Spine 16 can be smooth and/or non-smooth. Spine 16 can be rigid, flexible and/or any combination thereof. Although in one embodiment, plate 11, skirt 13, spine 16 and at least two of fins 14, including teeth 15, are unitary, in another embodiment, plate 11, skirt 13, spine 16 and at least two of fins 14, including teeth 15, are assembled into accessory 10. Whether in size, weight and/or properties, at least some and/or all spines 16 can be identical to each other, different from each other, even for a fin set, and/or any combination thereof. Spine 16 can have a height identical to or different from skirt 13. In another embodiment, accessory 10 lacks spine 16.

Skirt 13 has a portion 17 where skirt 13 lacks spine 16 depending therefrom. Portion 17 portion is located between two fin sets 14. In one example embodiment, at least some of fin 14 when organized into sets, can have those sets being angled less than 180 degrees from each other. Such angles can be 60 degrees, 90 degrees, 120 degrees and others. Such angles can all be equal, different and/or any combination thereof. In other embodiments, at least some of fin 14, when organized into sets, can have those sets being angled greater than 180 degrees from each other.

Figure 1B:
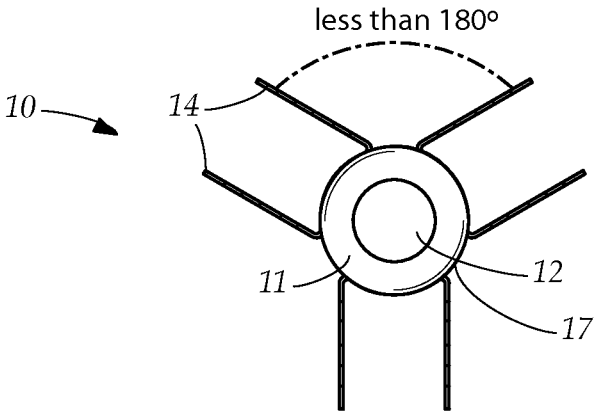
FIG. 1B shows a top view of an example embodiment of an arrow accessory according to the present disclosure.

FIG. 1B shows a top view of an example embodiment of an arrow accessory according to the present disclosure. Some elements of this figure are described above. Thus, same and/or similar reference characters identify same and/or like components described above and any repetitive detailed description thereof will hereinafter be omitted or simplified in order to avoid complication.

As shown in FIG. 1B, one can see that at least some of fins 14 when organized into sets, can have those sets being angled less than 180 degrees from each other. Such angles can be 60 degrees, 90 degrees, 120 degrees and others. Such angles can all be equal, different and/or any combination thereof. Also, as shown in FIG. 1B, three fin sets 14 are equally angled at 120 degrees therebetween.

Figure 2A:
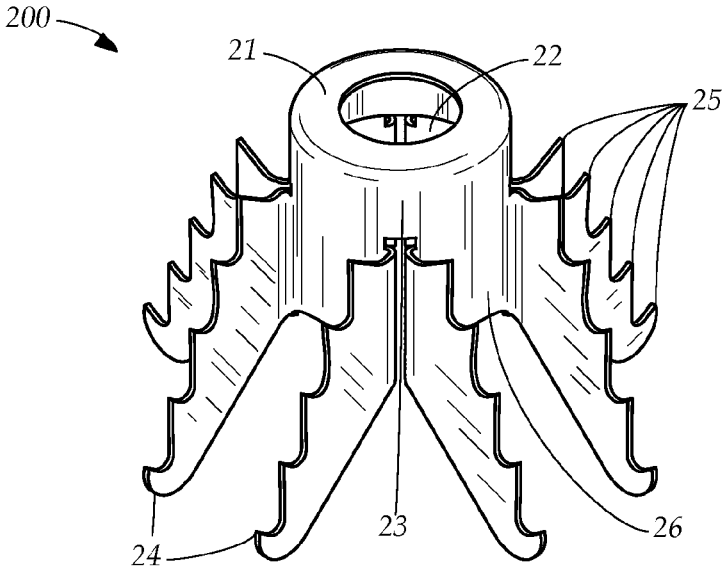
FIG. 2A shows a perspective view of an example embodiment of an arrow accessory according to the present disclosure.

FIG. 2A shows a perspective view of an example embodiment of an arrow accessory according to the present disclosure. Some elements of this figure are described above. Thus, same and/or similar reference characters identify same and/or like components described above and any repetitive detailed description thereof will hereinafter be omitted or simplified in order to avoid complication.

As shown in FIG. 2A, accessory 20 includes four fin sets 24.

Figure 2B:
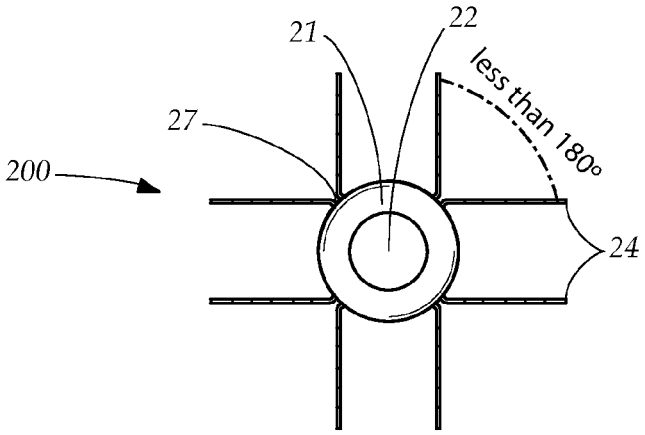
FIG. 2B shows a top view of an example embodiment of an arrow accessory according to the present disclosure.

FIG. 2B shows a top view of an example embodiment of an arrow accessory according to the present disclosure. Some elements of this figure are described above. Thus, same and/or similar reference characters identify same and/or like components described above and any repetitive detailed description thereof will hereinafter be omitted or simplified in order to avoid complication.

As shown in FIG. 2B, portion 27, which can be identical to and/or different from to portion 17, is smaller than portion 17, although portion 27 can also be larger than portion 17 in other embodiments. Also, four fin sets 14 are equally angled at 90 degrees therebetween.

Figure 3:
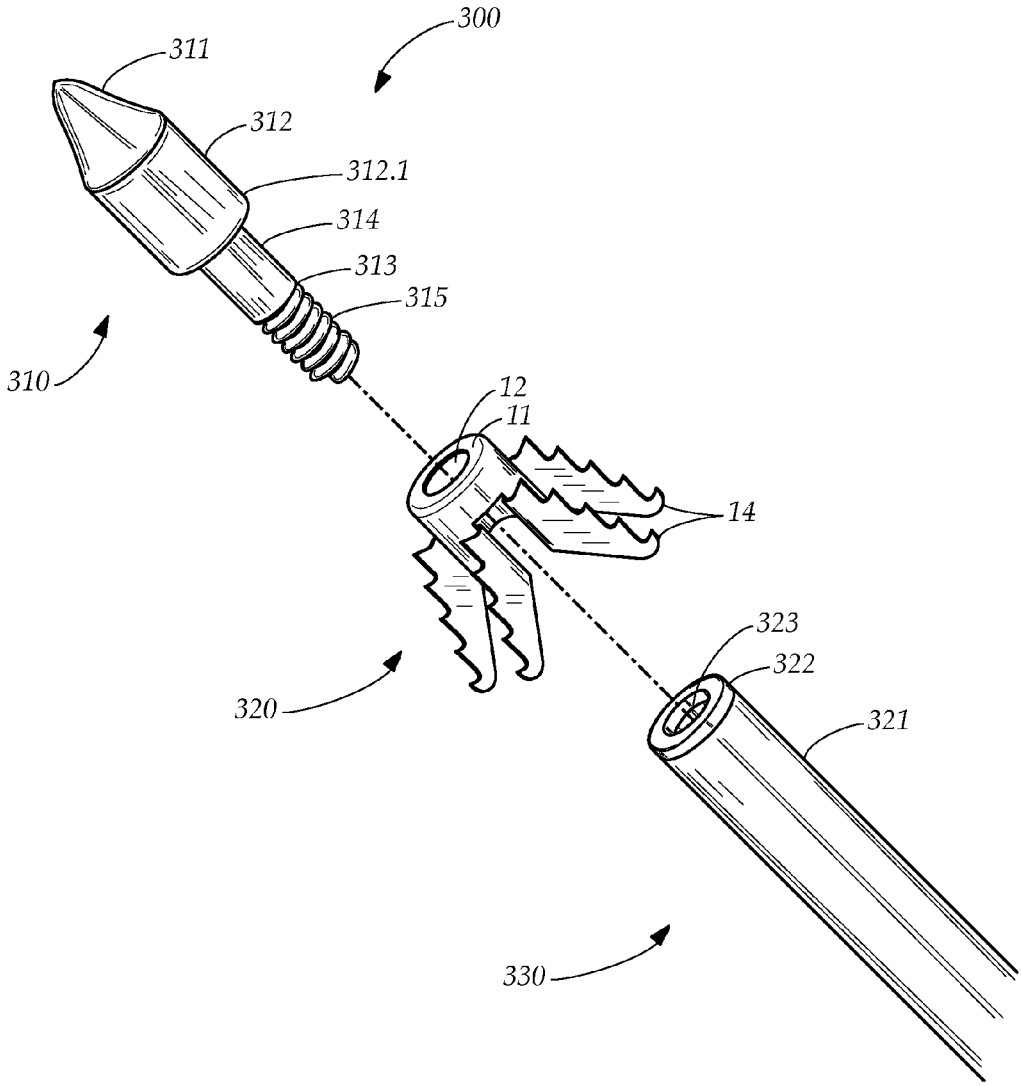
FIG. 3 shows a perspective view of an example embodiment of an unassembled arrow before use with an arrow accessory according to the present disclosure.

FIG. 3 shows a perspective view of an example embodiment of an unassembled arrow before use with an arrow accessory according to the present disclosure. Some elements of this figure are described above. Thus, same and/or similar reference characters identify same and/or like components described above and any repetitive detailed description thereof will hereinafter be omitted or simplified in order to avoid complication.

An accessory 320, which can be like accessory 10 and/or 200 described above, can be used with an arrow 300 having an arrowhead 310 and an arrow shaft 330. Accessory 320, which can be handheld, can be operative for single use, multiple uses and/or any combinations thereof. Accessory 320 and/or any component/sub-component thereof can be smaller than 5 inches. Arrow 300 can be used for any purpose, such as entertainment, sports, hunting and/or combat. Arrow 300 can have a circular, oval, square, triangular, rectangular, trapezoidal, pentagonal and/or any other cross-section. Arrow 300 can include metal, plastic, rubber, wood and/or any other materials. Arrow 300 can be used with a bow and/or a crossbow.

Arrowhead 310 includes an arrowhead tip 311 and an arrowhead body 312. Tip 311 can include metal, plastic, rubber, wood and/or any other materials. Tip 311 can be sharp, dull and/or any combination thereof. Tip 311 can be smooth, non-smooth and/or any combination thereof. Tip 311 can be unitary, assembled and/or any combination thereof.

Tip 311 can be rigid, flexible and/or any combination thereof. Tip 311 can be used for entertainment, sports, hunting and/or combat.

Body 312 can include metal, plastic, rubber, wood and/or any other materials. Body 312 can be sharp, dull and/or any combination thereof. Body 312 can be smooth, non-smooth and/or any combination thereof. Body 312 can be unitary, assembled and/or any combination thereof. Body 312 can be rigid, flexible and/or any combination thereof. Body 312 can be used for entertainment, sports, hunting and/or combat. Tip 311 and body 312 can be unitary, assembled and/or any combination thereof. Body 312 includes a base 312.1 which can come in contact with plate 11.

Arrowhead 310 has a shank 313 extending therefrom. Shank 313 can include metal, plastic, rubber, wood and/or any other materials. Shank 313 can be smooth, non-smooth and/or any combination thereof. Shank 313 can be unitary, assembled and/or any combination thereof. Shank 313 can be rigid, flexible and/or any combination thereof. Shank 313 can be used for entertainment, sports, hunting and/or combat. Shank 313, tip 311 and/or body 312 can be unitary, assembled and/or any combination thereof. Shank 313 includes a non-threaded portion 314 and/or a threaded portion 315, any of which can be structured as described herein.

Arrowhead 310 can be of any type, such as a broadhead, a bodkin point, a blunt, a judo point, a target point, a field point and/or a safety arrow. Arrowhead 310 can be hollow, solid and/or any combination thereof. Arrowhead 310 can include metal, plastic, rubber, wood and/or any other materials. Arrowhead 310 can have a circular, oval, square, rectangular, trapezoidal, pentagonal and/or any other cross-section.

Shaft 330 includes a body 321 and an open end 322. Body 321 can be hollow, solid and/or any combination thereof. Body 321 can include metal, plastic, rubber, wood and/or any other materials. Body 321 can have a circular, oval, square, triangular, rectangular, trapezoidal, pentagonal and/or any other cross-section. Body 321 can be unitary, assembled and/or any combination thereof.

Open end 322 is operative to receive shank 313 via a hole 323, which can be a circular, oval, square, triangular, rectangular, trapezoidal, pentagonal and/or any combination thereof. Shank 313 can be coupled to shaft 330 via open end 322 in many ways, such as fastening, mating, threading, pressure, magnets, adhesives and/or any other coupling way. Open end 322 can include metal, plastic, rubber, wood and/or any other materials. the fins positioned over the shaft further than the skirt. As shown in FIG. 3, shank 313 includes threaded portion 315 and shaft 330 is corresponding threaded within. Consequently, shank 313 is passed through hole 12 of accessory 320 into open end 322 via hole 323 and screwed, via threading, into shaft 330 and/or vice versa.

Figure 4:
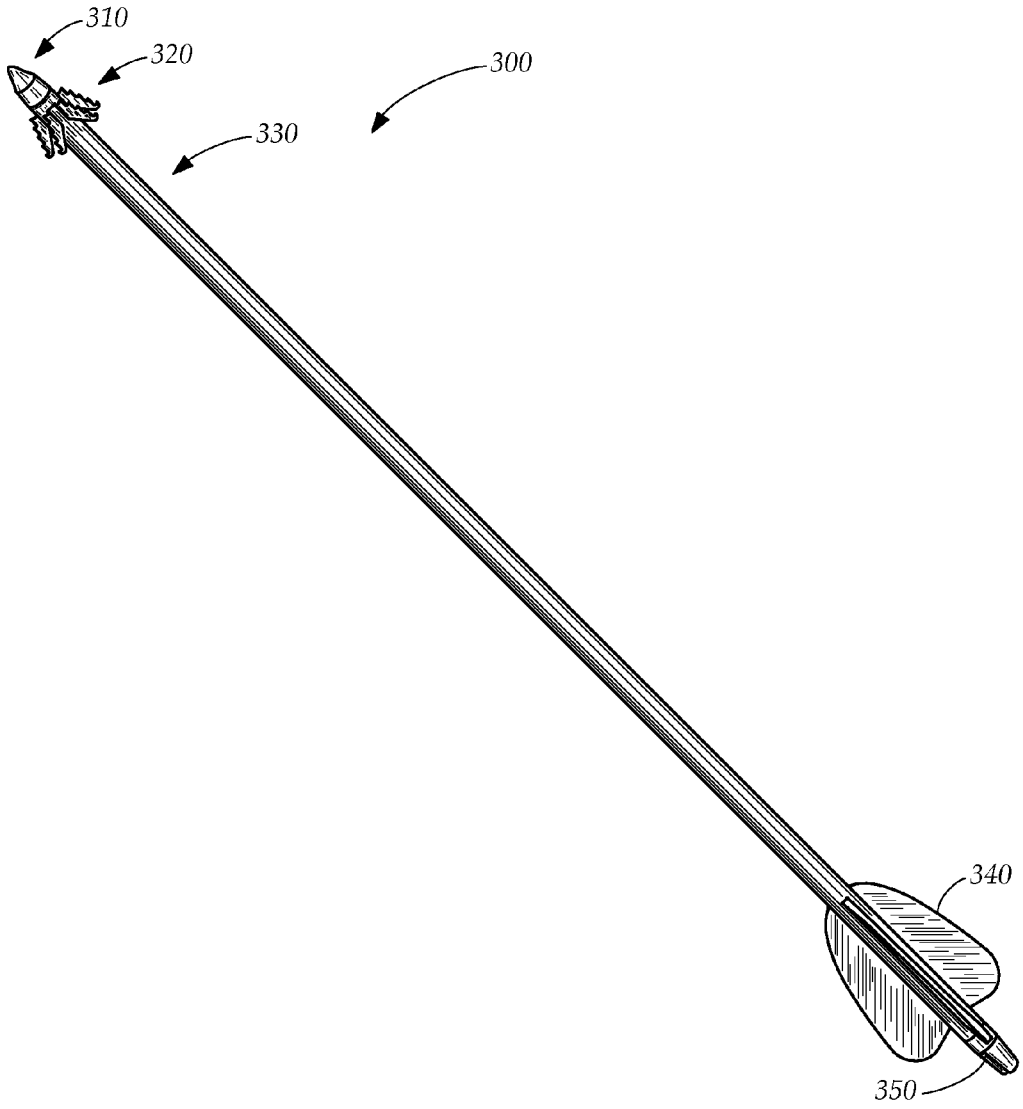
FIG. 4 shows a perspective view of an example embodiment of an assembled arrow with an arrow accessory according to the present disclosure.

FIG. 4 shows a perspective view of an example embodiment of an assembled arrow with an arrow accessory according to the present disclosure. Some elements of this figure are described above. Thus, same and/or similar reference characters identify same and/or like components described above and any repetitive detailed description thereof will hereinafter be omitted or simplified in order to avoid complication.

Arrow 300 is shown assembled with arrowhead 310, accessory 320 and shaft 330. Note that arrow 300 includes at least one fletching 340 and a nock 350, any of which can be structured as disclosed herein. Alternatively, arrow 300 can lack fletching 340 and/or nock 350. Also note that skirt 13, fins 14 and spine 16 are positioned over shaft 300. Spine 16 is positioned further down over shaft 300 than skirt 13 is positioned over shaft 300.

In other embodiments, accessory 10, 200 and/or 320 can be manufactured via several methods. One examples of such manufacturing method of manufacturing is manual and/or automatic assembly. Another example of such manufacturing method is die-cuffing, stamping, molding, 3-D printing and other similar methods, irrespective whether accessory 10, 200 and/or 320 is unitary and/or assembled and/or in any combination thereof.

The description of the present disclosure has been presented for purposes of illustration and description, but is not intended to be fully exhaustive and/or limited to the disclosure in the form disclosed. Many modifications and variations in techniques and structures will be apparent to those of ordinary skill in the art without departing from the scope and spirit of the disclosure as set forth in the claims that follow. Accordingly, such modifications and variations are contemplated as being a part of the present disclosure. The scope of the present disclosure is defined by the claims, which includes known equivalents and unforeseeable equivalents at the time of filing of this application.

What is claimed is:

1. An accessory for use with an arrow having an arrowhead and an arrow shaft, the arrowhead having a shank extending therefrom, the shaft having an open end operative to receive the shank, the accessory comprising:

a plate having a hole therethrough, the hole sized such that the shank is able to pass therethrough;

a skirt depending from the plate, the skirt having an edge portion distal to the plate;

a plurality of fins downwardly depending from the edge portion, the fins having forward-facing serrated edges.

2. The accessory of claim 1, wherein at least two of the fins are parallel to each other.

3. The accessory of claim 2, further comprising a spine downwardly depending from the edge portion, the at least two of the fins are extending from the spine.

4. The accessory of claim 3, wherein the plate, the skirt, the spine and the at least two of the fins are unitary.

5. The accessory of claim 3, wherein the fins include a plurality of fin sets, one of the fin sets includes the at least two of the fins.

6. The accessory of claim 5, wherein a section of the edge portion lacks the spine depending therefrom, the section is between the one of the fin sets and another one of the fin sets, the forward-facing edges of the at least two of the fins are substantially identically serrated.

7. The accessory of claim 6, wherein the forward-facing edges are sufficiently sharp for hunting.

8. The accessory of claim 7, wherein the one of the fin sets and the another one of the fin sets are angled less than 180 degrees from each other, the at least two of the fins are substantially identically sized.

9. The accessory of claim 1, wherein the forward-facing edges are serrated differently.

10. The accessory of claim 1, wherein the fins include a fin set having unparallel fins.

11. An accessory for use with an arrow having an arrowhead and an arrow shaft, the arrowhead having a shank extending therefrom, the shaft having an open end operative to receive the shank, the accessory comprising:

a plate having a hole therethrough, the hole sized such that the shank is able to pass therethrough, the plate having a periphery;

a skirt depending from the periphery, the skirt having an edge portion distal to the periphery;

a plurality of spines downwardly depending from the edge portion;

a first set of parallel fins extending from one of the spines, each fin in the first set having forward-facing serrated edges;

a second set of parallel fins extending from another one of the spines, each fin in the second set having forward-facing serrated edges.

12. The accessory of claim 11, wherein the plate, the skirt, the spines, the first set and the second set are unitary, the first set and the second set are angled less than 180 degrees from each other.

13. The accessory of claim 12, wherein the forward-facing edges of the at least one of the first set and the second set are sufficiently sharp for hunting.

14. The accessory of claim 11, wherein the forward-facing edges of the at least one of the first set and the second set are serrated differently.

15. An arrow comprising:

an arrowhead having a shank extending therefrom;

an arrow shaft having an open end in receipt of the shank;

a plate having a hole therethrough, the shank within the hole, the plate between the arrowhead and the shaft;

a skirt depending from the plate, the skirt positioned over the shaft, the skirt having an edge portion distal to the plate;

a plurality of fins downwardly depending from the edge portion, the fins having forward-facing serrated edges, the fins positioned over the shaft further than the skirt.

16. The arrow of claim 15, wherein at least two of the fins are parallel to each other.

17. The arrow of claim 16, further comprising a spine downwardly depending from the edge portion, the at least two of the fins are extending from the spine, the spine positioned over the shaft further than the skirt.

18. The arrow of claim 17, wherein the plate, the skirt, the spine, and the at least two of the fins are unitary.

19. The arrow of claim 17, wherein the fins include a first fin set and a second fin set, the first set includes the at least two of the fins, the first set and the second set are angled less than 180 degrees from each other, the forward-facing edges of at least one of the first fin set and the second fin set are sufficiently sharp for hunting.

20. The arrow of claim 15, wherein the fins include a fin set having unparallel fins.

* * * * *